US009488038B2

(12) United States Patent
De Ghetto et al.

(10) Patent No.: US 9,488,038 B2
(45) Date of Patent: Nov. 8, 2016

(54) EQUIPMENT FOR THE CONVEYING AND RECOVERY OF HYDROCARBONS FROM AN UNDERWATER WELL FOR THE EXTRACTION OF HYDROCARBONS, UNDER UNCONTROLLED RELEASE CONDITIONS

(75) Inventors: Giambattista De Ghetto, San Donato Milanese (IT); Paolo Andreussi, Milan (IT)

(73) Assignee: ENI S.P.A. (IT)

( * ) Notice: Subject to any disclaimer, the term of this patent is extended or adjusted under 35 U.S.C. 154(b) by 711 days.

(21) Appl. No.: 13/704,479

(22) PCT Filed: Jun. 10, 2011

(86) PCT No.: PCT/IB2011/001326
§ 371 (c)(1),
(2), (4) Date: Mar. 22, 2013

(87) PCT Pub. No.: WO2011/158093
PCT Pub. Date: Dec. 22, 2011

(65) Prior Publication Data

US 2013/0206421 A1 Aug. 15, 2013

(30) Foreign Application Priority Data

Jun. 17, 2010 (IT) ..... MI2010A1101

(51) Int. Cl.

| | |
|---|---|
| ***E21B 15/04*** | (2006.01) |
| ***B63C 7/00*** | (2006.01) |
| ***E21B 43/01*** | (2006.01) |
| ***E02B 15/08*** | (2006.01) |
| ***E02B 17/00*** | (2006.01) |
| ***E02D 23/00*** | (2006.01) |
| ***E21B 43/36*** | (2006.01) |

(52) U.S. Cl.
CPC ..... *E21B 43/0122* (2013.01); *E21B 43/36* (2013.01)

(58) Field of Classification Search
None
See application file for complete search history.

(56) References Cited

U.S. PATENT DOCUMENTS 4,416,565 A * 11/1983 Ostlund ..... E21B 43/0122 210/170.11
5,213,444 A * 5/1993 Henning ..... B01D 17/00 405/60
8,882,388 B2 * 11/2014 Kirkby ..... B63C 7/006 405/210

FOREIGN PATENT DOCUMENTS

CA 1107661 A1 8/1981
GB 2071020 A 9/1981

* cited by examiner

*Primary Examiner* — Matthew R Buck
*Assistant Examiner* — Douglas S Wood
(74) *Attorney, Agent, or Firm* — Tarolli, Sundheim, Covell & Tummino LLP

(57) ABSTRACT

The present invention relates to equipment for the conveying and recovery of hydrocarbons from an underwater well for the extraction of hydrocarbons under uncontrolled release conditions, comprising a chamber (23) for the separation of the hydrocarbon stream leaving the well, into a heavy phase (23*a*) and a light phase (23*b*), means (15,16,17,24,25,26) being envisaged, in connection with the separation chamber (23), for conveying the heavy phase (23*a*) and light phase (23*b*) towards the surface, characterized in that it comprises a directioning body (18) of the hydrocarbon stream, having a substantially cylindrical shape, or as a truncated paraboloid with both ends open, wherein a first end is an inlet of the hydrocarbon stream leaving the well, and a second end, distal with respect to the inlet of the hydrocarbon stream (20), is in fluid connection with the separation chamber (23) with the interpositioning of a perforated spherical cap (22).

14 Claims, 1 Drawing Sheet

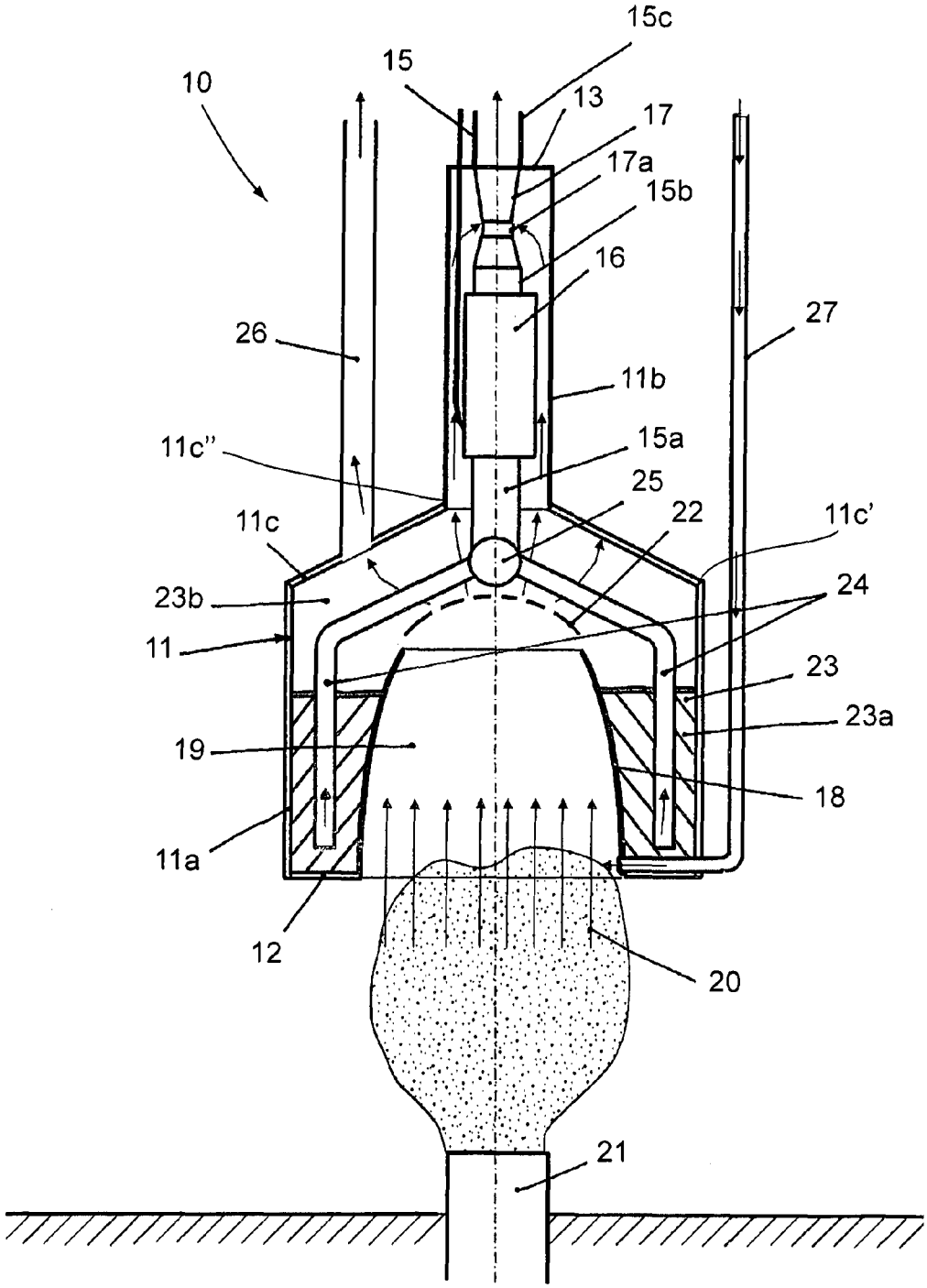
10
15
15c
13
17
17a
15b
16
26
27
11b
11c''
15a
25
22
11c
11c'
23b
24
11
23
23a
19
18
11a
12
20
21

EQUIPMENT FOR THE CONVEYING AND RECOVERY OF HYDROCARBONS FROM AN UNDERWATER WELL FOR THE EXTRACTION OF HYDROCARBONS, UNDER UNCONTROLLED RELEASE CONDITIONS

RELATED APPLICATION

This application is a National Phase filing of PCT/IB2011/001326, filed Jun. 10, 2011, which claims priority from Italian Application No. MI2010A 001101, filed Jun. 17, 2010, the subject matter which are incorporated herein by reference in their entirety.

The present invention relates to equipment for the conveying and recovery of hydrocarbons from an underwater well for the extraction of hydrocarbons under uncontrolled release conditions.

The constant increase in the worldwide demand for fluid hydrocarbons has led to a growing activity in the underwater or offshore exploration and production.

Underwater environments, in addition to making production more difficult, create an increased risk of environmental damage in the case of blowout events, i.e. uncontrolled release of hydrocarbons from the extraction wells, and/or other uncontrolled leakages of hydrocarbons into the sea, for example as a consequence of fractures of underwater piping.

These events, even if rare, not only cause a loss in terms of energy, but can also create severe consequences in terms of personnel safety, environmental pollution and well restoration costs.

Various attempts have been made in the past to guarantee an effective recovery of uncontrolled leakages of hydrocarbons in deep water.

In this respect, hollow containers have been produced, for example, such as that described in patent U.S. Pat. No. 4,318,442 which is essentially equipped with a chimney controlled by a valve, a gas outlet configured so as to maintain a gas stratification in the upper part of the container and a liquid discharge in correspondence with the oil stratification in the lower part of the container.

This container is positioned above the well outlet in blowout so as to capture the outgoing stream of hydrocarbons, also called plume, in order to convey its fluid part to the surface in a controlled manner, removing the gaseous part.

Alternatively, the use of dome-shaped protection shields is known, such as that proposed in the USA patent U.S. Pat. No. 4,405,258.

This patent describes a method for the containment of hydrocarbons inside a dome-shaped shield equipped with safety valves on its upper part which, positioned above an underwater well in blowout, entraps the hydrocarbons in its interior.

Structures positioned above the well outlet, however, whether they be hollow or dome-shaped container, have proved to be unsuitable for an effective containment of the blowout phenomenon, in particular of wells from which there is a great outflow of hydrocarbons. The power of these phenomena, in fact, tends to induce the hydrocarbons to exit not from the specific upward ducts but from the base of the structure.

The dome shape, moreover, is not effective in deviating high-rate streams.

Other equipment known for the containment or recovery of hydrocarbons in gaseous and/or liquid form is described in American patent U.S. Pat. No. 4,324,505.

This equipment comprises a cone containing suitable slits. When the apparatus is positioned at the well head, as far as is possible, it drives and directs the fluid through a duct connected to the upper portion of the cone, up to the surface where the hydrocarbons can be separated from the other fluids.

In this equipment, particularly for high-rate blowout streams, the impact of the plume inside the cone can generate turbulent motions which can cause the emission of the jet from the cone with a consequent reduced efficiency in the recovery of hydrocarbons coming out of the well.

The necessity is therefore felt, in the case of offshore blowout events, to efficiently intercept, contain and convey the outgoing hydrocarbons in order to reduce their uncontrolled dispersion in the environment to the minimum.

An objective of the present invention is to overcome the drawbacks mentioned above, and in particular to provide equipment for the conveying and recovery of hydrocarbons from an underwater well, under uncontrolled release conditions, which allow to carry out an effective and substantially complete recovery of hydrocarbons exiting in an uncontrolled manner.

Another objective of the present invention is to provide equipment for the conveying and recovery of hydrocarbons from an underwater well under uncontrolled release conditions, which is capable of reducing to the minimum the dispersion into the environment of hydrocarbons exiting in an uncontrolled manner.

A further objective of the present invention is to provide equipment for the conveying and recovery of hydrocarbons from an underwater well under uncontrolled release conditions, which allows the hydrocarbons exiting in an uncontrolled manner to be effectively intercepted, contained and conveyed.

Yet another objective of the present invention is to provide equipment for the conveying and recovery of hydrocarbons from an underwater well under uncontrolled release conditions, which is capable of separating the hydrocarbons coming from the well into a heavy phase consisting of water and liquid hydrocarbons and into a light phase mainly consisting of gas and liquid hydrocarbons and conveying said heavy phase to the surface.

These and other objectives according to the present invention are achieved by providing equipment for the conveying and recovery of hydrocarbons from an underwater well under uncontrolled release conditions as explained in the independent claims.

Further characteristics of the equipment for the conveying and recovery of hydrocarbons from an underwater well under uncontrolled release conditions are object of the dependent claims.

The characteristics and advantages of equipment for the conveying and recovery of hydrocarbons from an underwater well under uncontrolled release conditions, according to the present invention, will appear more evident from the following illustrative and non-limiting description referring to the enclosed schematic drawings in which FIG. 1 is a sectional schematic view of the equipment for the conveying and recovery of hydrocarbons from an underwater well under uncontrolled release conditions, according to a preferred embodiment of the present invention.

With reference to the figure, this shows equipment for the conveying and recovery of hydrocarbons from an underwater well under uncontrolled release conditions, indicated as a whole as 10.

The equipment 10 for the conveying and recovery of hydrocarbons, comprises a chamber 23 for the separation of the flow of hydrocarbons coming from the well 21 into a heavy phase 23*a* and a light phase 23*b*.

In particular, means 15, 16, 17, 24, 25, 26 for the conveying of the heavy phase 23*a* and light phase 23*b* towards the surface, are envisaged in connection with the separation chamber 23.

According to the present invention, the equipment for the conveying and recovery of hydrocarbons also comprises a directioning body 18 of the hydrocarbon stream, having a substantially cylindrical shape, or as a truncated paraboloid with both ends open, wherein a first end is an inlet of the hydrocarbon stream coming from the well 21, and a second end, distal with respect to the inlet of the hydrocarbon stream 20, is in fluid connection with the separation chamber 23 with the interpositioning of a perforated spherical cap 22.

In the preferred embodiment illustrated, the separation chamber 23 is defined inside a hollow tubular body 11 comprising two hollow cylindrical portions 11*a*, 11*b* connected by a portion having a tapered conformation 11*c*.

A first cylindrical portion 11*a* is connected to the tapered portion 11*c* in correspondence with the enlarged end 11*c*' of the same 11*c*.

The first cylindrical portion 11*a* of the hollow body 11 ends with an annular base 12 defining an opening of the hollow tubular body 11 with reduced diameter with respect to the diameter of the first cylindrical portion 11*a*.

A second cylindrical portion 11*b* is connected to the tapered portion 11*c* in correspondence with the narrower end 11*c*" of the same 11*c*.

The tapered portion 11*c* preferably has a truncated-conical shape with the smaller diameter coinciding with the diameter of the portion of the second cylindrical portion 11*b* and the larger diameter coinciding with the diameter of the first cylindrical portion 11*a* of the tubular body 11.

The second cylindrical portion 11*b* ends, in correspondence with its free end, with an upper base 13, so as to define a closed containment space.

The separation chamber 23 is delimited in the perimeter and externally by the tubular body 11 and internally and centrally by the perforated cap 22 and by the hollow body 18 for directing the incoming flow so as to have a substantially annular conformation.

For this purpose, the directioning body 18 is arranged coaxially with the tubular body 11 and extends internally to the same.

The directioning body 18 preferably has, at least in correspondence of its own inlet end of the hydrocarbon flow, a diameter coinciding with the inner diameter of the annular base 12 and an extension substantially equal to the development of the first cylindrical portion 11*a* of the tubular body 11.

The directioning body 18 is open in correspondence with both its ends, thus allowing, once positioned in correspondence with the outflow of hydrocarbons, the plume 20 coming from the well 21 to be conveyed into its interior 19.

The hollow perforated spherical cap 22 is situated, however, in correspondence with the end of the directioning body 18, distal with respect to the inlet of the hydrocarbon flow 20, preferably in a position distant from the directioning body 18.

The geometry of the directioning body 18 and perforated cap 22 is such as to attenuate the momentum of the plume of the multiphase stream at the inlet.

The gravitational separation of the incoming mixture into dense or heavy phase 23*a* and light 23*b* phase takes place inside the separation chamber 23.

The separation chamber 23 is in fluid connection with the means 15, 16, 17, 24, 25, 26 for conveying the heavy phase 23*a* and light phase 23*b* towards the surface.

In particular, the lower part of the separation chamber 23*a*, in which the dense phase 23*a* is stratified, is in fluid communication with pumping means 16 situated inside the second cylindrical portion 11*b* of the hollow tubular body 11.

The fluid connection takes place by means of a plurality of conveying pipes 24, angularly spaced, preferably equispaced, consisting of a first vertical section and subsequently converging into a common collector 25 overlying the perforated cap 22.

The collector 25 is arranged centrally with respect to the tubular body 11 and is, in turn, connected with the pumping means 16 through a first section 15*a* of a conveying duct 15 situated inside the hollow tubular body 11, between the tapered portion 11*c* and the second cylindrical portion 11*b* of the hollow tubular body 11, coaxially with respect to the same.

A second section 15*b* of the conveying duct 15, again situated inside and coaxially to the second cylindrical portion 11*b*, puts the pumping means 16 in fluid communication with an ejection system 17, inside the second cylindrical portion 11*b*, also equipped with suction doors 17*a* for the suction of the light phase 23*b*.

A third and last section 15*c* of the conveying duct is inserted on the upper base 13 of the second cylindrical portion 11*b* and puts the multiphase stream produced inside the ejection system 17 in fluid communication with suitable treatment and collection systems situated on the sea surface (not illustrated).

The upper part of the separation chamber 23, in which the light phase is stratified, is in fluid communication with the surface by means of a vent duct 26 intercepted by a regulation valve (not illustrated) in the collection point on the sea surface.

A fluid connection duct 27 with the surface is also envisaged, which extends for a first section externally and parallel to the tubular body 11 and is inserted for a subsequent section on the directioning body 18 passing through the wall of the first cylindrical portion 11*a* of the tubular body 11.

Said duct 27 for fluid connection with the surface is suitable for feeding a methanol distribution system (not illustrated), positioned in correspondence with the lower end of the directioning body 18.

The functioning of the equipment 10 for conveying and recovering hydrocarbons from an underwater well for extraction is as follows.

In operative condition, the plume 20, consisting of a mixture of gas and oil, leaves the well at high pressure 21, thus englobing seawater in its interior.

The inlet of seawater inside the equipment for the conveying and recovery of hydrocarbons 10 favours the formation of the heavy liquid phase 23*a*. The quantity of seawater entering the equipment for the conveying and recovery of hydrocarbons 10 can be controlled by varying the height at which the equipment 10 is positioned with respect to the sea bottom, together with the dimensions and rotation rate of the pumping means 16.

The multiphase stream at the inlet 20, generally consisting at least of oil, gas and seawater, enters the equipment for the conveying and recovery of hydrocarbons 10 through the hollow directioning body 18.

The geometry of said directioning body 18, together with that of the perforated cap 22, is such as to attenuate the momentum of the ingoing stream 20, preventing a downward reflux of the plume 20 and consequently its outflow.

Passing through the holes of the perforated cap 22, the multiphase stream 20 enters the separation chamber 23.

In its interior, the oil-gas-water mixture tends to separate and become stratified into two phases: a light phase 23*b*, consisting of a mixture of gas and liquid hydrocarbons, is formed on the upper part of the separation chamber 23, and a dense phase 23*a*, consisting of a mixture of water and liquid hydrocarbons containing limited quantities of dispersed gas, is formed on the lower part of the separation chamber 23.

The dense phase 23*a* is directed from the separation chamber 23, through the plurality of conveying pipes 24, towards the collector 25, due to the pumping means 16, and is conveyed at high pressure into the ejection system 17.

A part of the light phase 23*b* separated in the separation chamber 23, is sucked at low pressure by the suction doors 17*a* of the ejection system 17.

The multiphase stream produced in the ejection system 17 is then conveyed through the third section 15*c* of the conveying duct 15 in the direction of the sea surface towards specific conveying and recovery means.

The remaining portion of light phase 23*b* is extracted through the vent duct 16.

The distribution between the light phase 23*b* sucked by the ejection system 17 and that extracted through the vent duct 26, is regulated by the regulation valve situated on the vent duct 26.

The regulation valve also has the function of keeping the vent duct 26 full of air, guaranteeing the correct functioning of the system during the initial conveyance and recovery phases of the hydrocarbon mixture.

During the recovery of the hydrocarbons, the methanol is also distributed from the surface by means of the fluid connection duct 27 with the surface to the methanol distribution system in correspondence with the inlet of the plume 20 in order to prevent the formation of hydrates.

The characteristics of the equipment for the conveying and recovery of hydrocarbons from an underwater well for extraction, object of the present invention, as also the relative advantages, are evident from the above description.

The particular conformation of the directioning body of the flow, in addition to the perforated spherical cap at its end, allows the momentum of the multiphase stream at the inlet to be attenuated, thus preventing a downward reflux of the same and consequently its outflow.

Furthermore, the passage through the perforated cap facilitates an effective separation of the multiphase stream into a light phase and heavy phase, favouring its conveyance towards the surface.

Finally, the equipment thus conceived can obviously undergo numerous modification and variants, all included in the invention; all the details, moreover, can be substituted by technically equivalent elements. In practice the materials used, as also the dimensions, can vary according to technical requirements.

The invention claimed is:

1. Equipment for the conveying and recovery of a stream of hydrocarbons from an underwater well under uncontrolled release conditions, comprising a chamber for the separation of said hydrocarbon stream leaving said well, into a heavy phase and a light phase, means being envisaged, in connection with said separation chamber, for conveying said heavy phase and said light phase, towards the surface, wherein it comprises a directioning body of said hydrocarbon stream, having a substantially cylindrical shape, or as a truncated paraboloid with both ends open, wherein a first end is an inlet of said hydrocarbon stream leaving said well, and a second end, distal with respect to the inlet of said hydrocarbon stream, is in fluid connection with said separation chamber with the interpositioning of a perforated spherical cap, wherein at least a portion of said separation chamber extends annularly about at least one of said perforated cap and said directioning body.

2. The equipment for the conveying and recovery of a stream of hydrocarbons from an underwater well under uncontrolled release conditions according to claim 1, wherein said perforated spherical cap is positioned at a distance with respect to said distal end of said directioning body.

3. The equipment for the conveying and recovery of a stream of hydrocarbons from an underwater well under uncontrolled release conditions according to claim 1, wherein said separation chamber is defined inside a hollow tubular body, said separation chamber being perimetrically and externally delimited by said tubular body, and internally and centrally by said perforated cap and said directioning body so as to extend annularly about at least one of said perforated cap and said directioning body.

4. The equipment for the conveying and recovery of a stream of hydrocarbons from an underwater well under uncontrolled release conditions according to claim 1, wherein said hollow tubular body comprises a first and a second cylindrical portion interlinked by means of a portion having a tapered conformation, said first cylindrical portion being connected to said tapered portion in correspondence with an enlarged end of the same and said second cylindrical portion being connected to said tapered portion in correspondence with a narrowed end of the same, the lower part of said first cylindrical section ending with an annular base defining an opening of said hollow tubular body having a reduced diameter with respect to the diameter of said first cylindrical portion and the upper part of said second cylindrical portion ending with an upper base.

5. The equipment for the conveying and recovery of a stream of hydrocarbons from an underwater well under uncontrolled release conditions according to claim 4, wherein said directioning body is coaxially arranged with respect to said tubular body and extends inside the same, said directioning body having a diameter coinciding with the inner diameter of said annular base at least in correspondence with said first end, is an inlet, and an extension substantially the same as the expansion of said first cylindrical section of said tubular body.

6. The equipment for the conveying and recovery of stream of hydrocarbons from an underwater well under uncontrolled release conditions according to claim 1, wherein a lower part of said separation chamber, in which said heavy phase is stratified, is in fluid communication with pumping means by means of a plurality of conveying pipes angularly spaced and interlinked in a collector overlying said perforated cap-said collector being connected to said pumping means through a first section of a conveying duct towards the surface.

7. The equipment for the conveying and recovery of a stream of hydrocarbons from an underwater well under uncontrolled release conditions according to claim 6, wherein said pumping means are situated in fluid communication with an ejection system by means of a second section of said conveying duct towards the surface.

8. The equipment for the conveying and recovery of a stream of hydrocarbons from an underwater well under uncontrolled release conditions according to claim 1, wherein an upper portion of said separation chamber, in which said light phase is stratified, is in fluid communication with the surface by means of a vent duct.

9. The equipment for the conveying and recovery of a stream of hydrocarbons from an underwater well under uncontrolled release conditions according to claim 6, wherein said pumping means-and said ejector are positioned inside said second cylindrical portion of said hollow tubular body, said conveying duct towards the surface passing coaxially through said second cylindrical portion.

10. The equipment for the conveying and recovery of a stream of hydrocarbons from an underwater well under uncontrolled release conditions according to claim 1, wherein it comprises a duct for fluid connection with the surface, and extends for a first section externally and parallel to said tubular body and for a subsequent section is inserted on said directioning body, passing through the wall of said first cylindrical section of said tubular body.

11. The equipment for the conveying and recovery of a stream of hydrocarbons from an underwater well under uncontrolled release conditions according to claim 1, wherein said separation chamber extends entirely around said perforated cap and said directioning body.

12. The equipment for the conveying and recovery of a stream of hydrocarbons from an underwater well under uncontrolled release conditions according to claim 1, wherein the equipment is capable of being spaced from the sea bottom such that the directioning body is capable of receiving sea water with the hydrocarbon stream for removing the heavy phase and the light phase from a mixture of the hydrocarbon stream and the sea water.

13. Equipment for the conveying and recovery of a stream of hydrocarbons from an underwater well under uncontrolled release conditions, comprising:

a chamber for the separation of the hydrocarbon stream leaving the well into a heavy phase and a light phase;

structure for conveying the heavy phase and the light phase towards the surface;

a directioning body of the hydrocarbon stream extending along an axis and having a substantially cylindrical shape, or as a truncated paraboloid with both ends open, wherein a first end is an inlet of the hydrocarbon stream leaving the well, and a second end, distal with respect to the inlet of the hydrocarbon stream, is in fluid connection with the separation chamber; and a perforated spherical cap connected to the second end of the directioning body such that the separation chamber extends about the axis entirely around the directioning body and the perforated cap.

14. The equipment for the conveying and recovery of a stream of hydrocarbons from an underwater well under uncontrolled release conditions according to claim 13, wherein the equipment is capable of being spaced from the sea bottom such that the directioning body is capable of receiving sea water with the hydrocarbon stream for removing the heavy phase and the light phase from a mixture of the hydrocarbon stream and the sea water.

* * * * *